United States Patent [19]

Sasaki et al.

[11] Patent Number: 4,969,335

[45] Date of Patent: Nov. 13, 1990

[54] REFRIGERATION APPARATUS FOR TRANSPORT CONTAINERS

[75] Inventors: Tatsuroh Sasaki, Nara; Syozoh Kameyama, Sakai, both of Japan

[73] Assignee: MItsui O.S.K. Lines, Ltd., Osaka, Japan

[21] Appl. No.: 403,696

[22] Filed: Sep. 6, 1989

[30] Foreign Application Priority Data

Sep. 7, 1988 [JP] Japan ..... 63-224062

[51] Int. Cl.[5] ..... F25B 41/04

[52] U.S. Cl. ..... 62/196.4; 62/91; 62/513

[58] Field of Search ..... 62/196.4, 91, 113, 285, 62/288, 290, 291, 277, 278, 513

[56] References Cited

U.S. PATENT DOCUMENTS 2,065,358 12/1936 Zarotschenzeff ..... 62/91
3,071,935 1/1963 Kapeker ..... 62/196.4 X
3,412,571 11/1968 Bolynn ..... 62/91 X
3,453,838 7/1969 Decker et al. ..... 62/196.4 X
4,240,266 12/1980 Scrine et al. ..... 62/196.4
4,327,558 5/1982 Howland et al. ..... 62/196.4 X

FOREIGN PATENT DOCUMENTS 63-063671 4/1988 Japan .

*Primary Examiner*—Harry B. Tanner
*Attorney, Agent, or Firm*—Thompson, Hine and Flory

[57] ABSTRACT

A refrigeration apparatus including a hot gas bypass pipe provided in a refrigeration circuit is constructed by connecting a compressor, a condenser, an expansion valve and an evaporator, a humidifier for humidifying the inside of a chamber, a heat exchanger located between a feed pipe for supplying water to said humidifier and said hot gas bypass pipe. This apparatus prevents freezing of water inside the pipes.

9 Claims, 3 Drawing Sheets

REFRIGERATION APPARATUS FOR TRANSPORT CONTAINERS

BACKGROUND OF THE INVENTION

This invention relates to a refrigeration apparatus for containers used for transporting perishable food.

Generally, perishables must be stored at optimum temperatures to maintain the freshness. For example, if the perishables to be stored are vegetables and fruits, a temperature range that is not too low is required. Likewise, fish and meat of which the taste deteriorates due to freezing needs to be stored at a temperature that does not cause freezing.

To meet such freshness requirements, perishables are usually transported by air which is shorter in time than other transportation means. When transporting perishables which deteriorate very quickly, it is very difficult to maintain the freshness of the commodities when using transportation means other than air transportation.

To overcome this difficulty with non-air transport systems, the idea of controlling the humidity, in addition to setting the temperature of the transport container has been used to maintain the freshness of the commodities to be transported. (i.e. A refrigeration container is provided with a humidifying apparatus for transporting perishables.) Since humidity as high as 85 to 95% is generally required in these containers, a humidifying apparatus and its peripheral equipments of higher performance are required.

A conventional humidifying apparatus installed in a container to meet this requirement is disclosed in Japanese Utility Model Application Laying Open Gazette No. 63-63671. The humidifying apparatus in this application consists mainly of an ultrasonic humidifier (a), reserve tanks (b), and a pump (c) (See FIG. 4). The ultrasonic humidifier is continuously fed with water by the pump (c) through a feed water pipe (d). Surplus water in the ultrasonic humidifier (a) continuously returns to each reserve tank (b) through a return pipe (e). The water in the ultrasonic humidifier (a) is atomized by the ultrasonic waves of a vibrating portion of the humidifier and is discharged.

Heaters (f) for preventing freezing of the water in the pipes are disposed respectively in the ultrasonic humidifier (a) and each reserve tank (b). Each reserve tank (b) is connected with a drain pipe (h) for returning water and residue collected in a drain pan (g) located at the lower part of the refrigeration unit. The drain pipe is drained by a plug. Water collected in the drain pan (g) is recycled.

Humidifying apparatus provided with heaters for preventing freezing of water in the pipes have disadvantages such as reduced maintainability and increased cost due to complex construction. These problems are caused by the following reasons.

(1) An electric heater having a limited life involves regular maintenance.

(2) Safety devices are necessary to avoid breakdown of the heater when water in the reserve tank is depleted.

(3) A thermostat is required for controlling the water temperature according to the amount and the temperature of water in the reserve tank and ultrasonic humidifier.

SUMMARY OF THE INVENTION

The object of the present invention is to prevent freezing of water in pipes without installing a heater.

To acheive the above-mentioned object, the invention provides the following apparatus.

The apparatus in the present invention comprises a closed refrigeration circuit which connects a compressor, a condenser, an expansion mechanism and an evaporator for generating cooling air to cool a chamber by the evaporator, and a hot gas bypass pipe for supplying hot gas discharged from the compressor in the refrigeration circuit to an inlet side of the evaporator bypassing the condenser and the expansion mechanism. The apparatus further comprises a flow control valve for regulating the amount of the hot gas flowing through the hot gas bypass pipe, and hot gas control means for controlling the flow control valve to increase and decrease the amount of the hot gas flowing through the hot gas bypass pipe in accordance with the cooling load in a chamber during a chilled mode. In addition to the abovementioned structure, the apparatus incorporates a humidifier for humidifying the chamber by spraying water on the cooling air generated in the evaporator, and feed water means for supplying water to the humidifier. Furthermore, a heat exchanger is provided between one portion of the hot gas bypass pipe and one portion of the feed water pipe to heat-exchange the feed water supplied to the humidifier with the hot gas in order to heat the feed water.

With this construction, when the container is chilled, the hot gas control means can maintain the temperature in the chamber at the prescribed level by controlling the temperature of the cooling air generated in the evaporator by increasing and decreasing the amount of the hot gas flowing through the hot gas bypass pipe in accordance with the cooling load. Further, water is supplied from the feed water means to the humidifier to generate a mist which is sprayed in the cooling air to humidify the chamber. The water supplied to the humidifier is heated by heat-exchange with the hot gas, hence preventing freezing of water in the pipes.

BRIEF DESCRIPTION OF THE DRAWINGS

FIG. 1 shows a feed water circuit of a humidifier and a refrigeration circuit.

FIG. 2 shows a partly side elevational view of a refrigeration transport container.

FIG. 3 shows the relationship between the temperature of the water fed to a humidifier and the atomizing capacity of a humidifier.

DETAILED DESCRIPTION OF THE INVENTION

One of the preferred embodiments of the present invention will be described with reference to the accompanying drawings.

Figure 1:
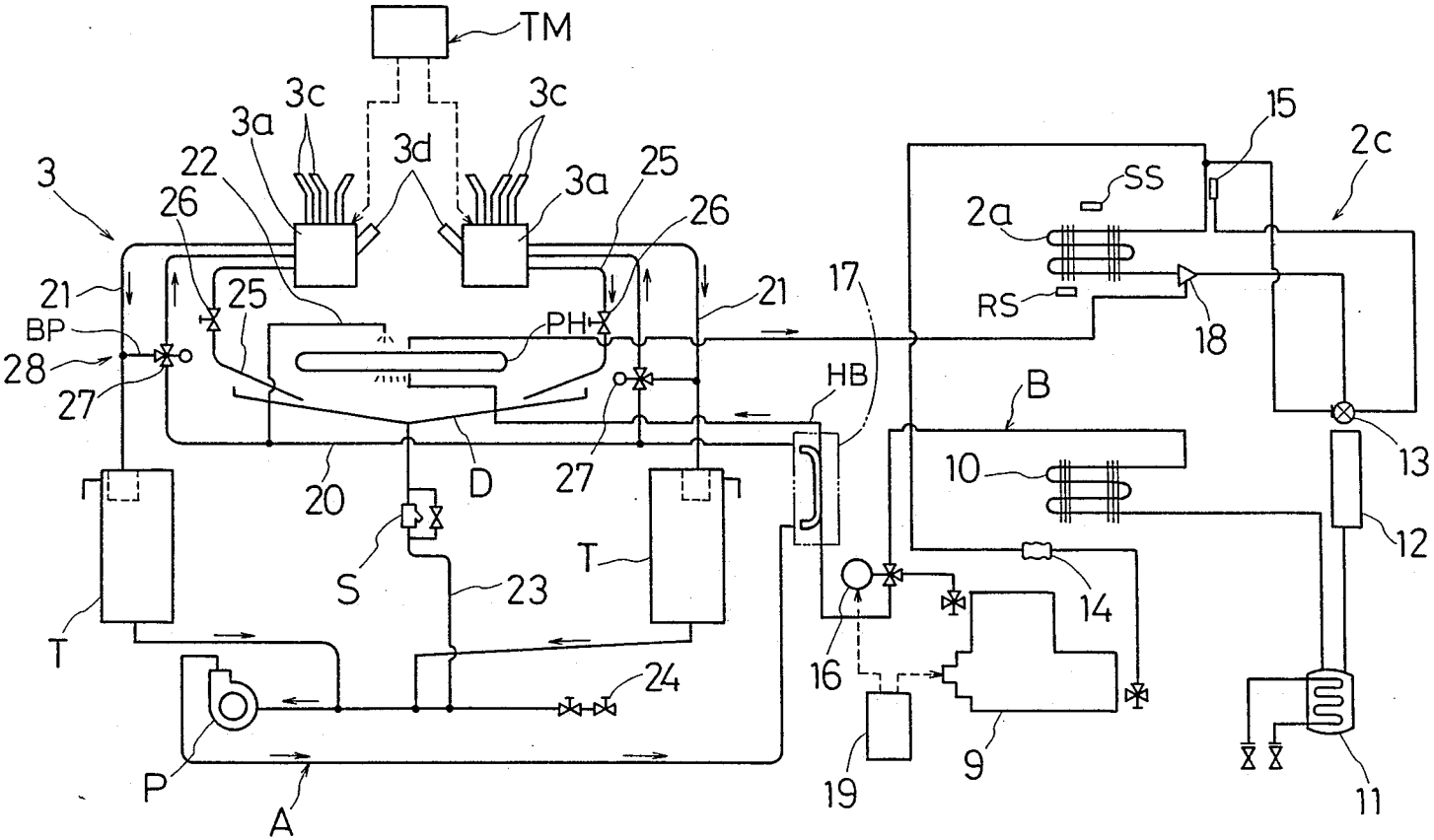
FIGS. 1 through 3 show the embodiment of the present invention.
Figure 2:
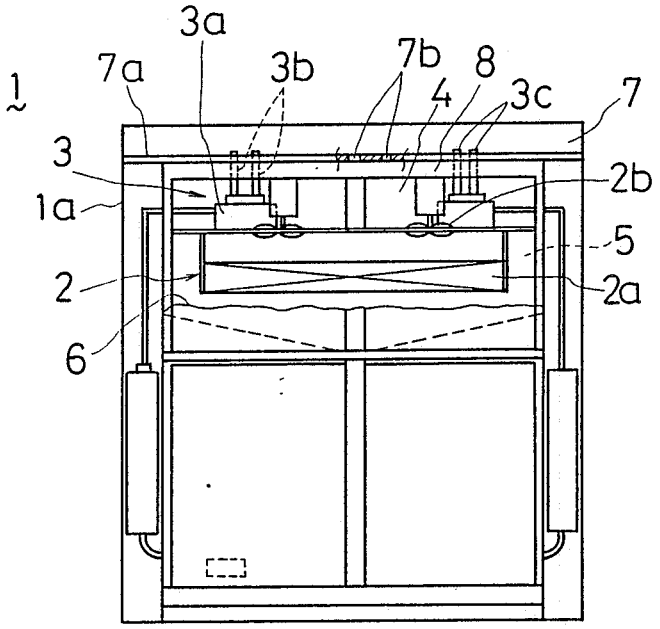

As shown in FIG. 1 and FIG. 2, a refrigeration transport container (1) provided with a refrigeration unit (2) and humidifying means (3) on one end wall thereof, is used for transportation of perishables.

A chamber (5) in the container body (1*a*) serves as a storage chamber for commodities. Provided on the end wall of the container body (1*a*) is a partition (6) to form unit chamber (4) inside the partition (6). The unit chamber (4) accomodates a portion of the humidifying means (3) and the refrigeration unit (2). Provided inside the upper part of the chamber (5) is a ceiling duct (7a) constituting a discharge passage (7) through which the humidified cooling air is supplied from the unit chamber (4). The ceiling duct (7a) has holes (7b) for discharging the cooling air to the chamber (5). In container body (1a), the cooling air and the mist generated respectively in the refrigeration unit (2) and the humidifying means (3) respectively are supplied to the chamber (5) from holes (7b) through discharge passage (7). Thus, container body (1a) can maintain perishables stored in the chamber (5) fresh by the cooling air and the mist. In addition, a sectional area of the discharge passage (7) is about ⅓ of the size of a cooling passage (8) located at the upper part of the unit chamber (4) to provide an outlet for the cooling air and the mist. Therefore, the cooling air from the unit chamber (4) accelerates in speed and decreases in pressure when flowing into the discharge passage (7) from the cooling passage (8). Diameter of openings (7b) varies according to the distance thereof from the unit chamber (4) to maintain the temperature and the humidity in the chamber (5) at a fixed level. Therefore, the opening (7b) adjacent to the unit chamber (4) has the smallest diameter and the diameter of the openings increase as they are located away from the unit chamber (4). At the lower part of the partition between chambers (4) and (5), an opening is provided (not shown in drawings) to enable chamber (5) to communicate with the unit chamber (4). Air from chamber (5) is introduced into unit chamber (4) through this opening.

The refrigeration unit (2), which is conventional, is provided with an evaporator (2a) and a fan (2b). The refrigeration unit (2) sucks the air from the lower part of the unit chamber (4), cools it by evaporator (2a) and then discharges it from cooling passage (8) to discharge passage (7).

The humidifying means (3) is constituted mainly by an ultrasonic humidifier (3a) disposed adjacent to the refrigeration unit (2). The humidifier (3a) generates mist by scattering the water stored in the tank by the ultrasonic waves from the vibrator. The mist is discharged from an ejection nozzle (3b). An air intake opening (3d) (FIG. 1) of the humidifier (3a) is disposed downstream of the fan (2b). Injection opening (3c) of the ejection nozzle (3b) in humidifier (3a) is located at the inlet of the discharge passage (7), or at the boundary between the cooling passage (8) and the discharge passage (7).

The humidifiers (3a) are connected with timer means (TM) which output signals to activate the humidifiers for a predetermined time for a fixed period (Refer to FIG. 1). The timer means outputs a control signal to the humidifiers (3a) to repeat a sequence of operation, for example, a sequence of activating the ultrasonic humidifiers for 5 minutes and deactivating the humidifiers for 5 minutes. The set time of the operational sequence of activation and deactivation is variable. Accordingly, the proper humidity for each perishable can be adjusted by appropriately setting the timer means.

Refrigeration unit (2) and the humidifying means (3) is discussed in detail with reference to the circuit shown in FIG. 1. The refrigeration circuit (2c) of the refrigeration unit (2) comprises, from the discharge side of compressor (9), an air-cooled condenser (10), a water-cooled condenser (11), accessories (12) including an accumulator, an expansion mechanism (13) and an evaporator (2a). Compressor (9), condensers (10), (11) and evaporator (2a) are connected by refrigerant piping (B) with evaporator (2a) connected on the suction side of compressor (9) to form a closed circuit. In this circuit, high pressure refrigerant compressed in the compressor (9) is condensed in the condensers (10), (11), evaporated in the evaporator (2a) and then returned to the compressor (9). The evaporator (2a) generates the cooling air by heat-exchanging with the air in the cooling passage (8). The expansion valve (13) is controlled by thermister (15), which is located at the outlet side of the evaporator (2a), by detecting the temperature of the refrigerant. Provided between the compressor (9) and the air-cooled condenser (10) on refrigerant piping (B) is three-way modulating flow control valve (16). Connected to the three-way modulating valve (16) on one end thereof is hot gas bypass pipe (HB). The hot gas bypass (HB) connects heat-exchanger (17) for feed water to drain pan heater (PH). Both heat-exchanger (17) and drain pan heater (PH) are linked to the inlet side of the evaporator (2a) by distributor (18).

Inside the refrigeration unit (2), a supply sensor (SS) and a return sensor (RS) are disposed. Both of the sensors (SS) and (RS) are connected with a controller (19) which controls the three-way modulating valve (16) and the compressor (9) depending on the temperature of the chamber, or the supply air temperature detected by the supply sensor (SS), or the suction air temperature detected by the return sensor (RS). The controller (19) constitutes a hot gas control means which controls temperature in a chilled and frozen mode according to the set temperature (ST) in the chamber (5). For instance, when a set temperature is set at not less than −5° C., the controller (19) switches the operation to a chilled mode according to the supply air temperature. On the other hand, for example, when a set temperature is set below −5° C., the controller (19) switches the operation to a frozen mode according to the suction air temperature. In the chilled mode, when the detected temperature by the supply sensor (SS) (the supply air temperature) rises to not less than the predetermined temperature of the set temperature (ST), for example, higher than the set temperature by not less than 2° C., the controller (19) controls the three-way modulating valve (16) for directing the flow of hot gas into each condenser (10), (11). By comparison, in the chilled mode, when the supply air temperature becomes within the predetermined range of the set temperature (ST), the controller (19) PID (proportional-plus-integral-plus-derivative) controls the three-way modulating valve (16), to increase or decrease the amount of the hot gas flowing through the hot gas bypass passage (HB) to adjust the supply air temperature to be the set temperature (ST) based on the detected temperature of the supply sensor (SS). Furthermore, in the chilled mode, when the supply air temperature falls to not more than the predetermined temperature range (for example, by not less than 2° C.) of the setting temperature (ST), the controller (19) controls the three-way modulating valve (16) for directing the flow of all hot gas into the hot gas bypass passage (HB). In the frozen mode, the controller (19) controls the three-way modulating valve (16) for closing the hot gas bypass passage (HB). In addition to the above modes, the controller (19) shuts off the compressor (9) when the detected temperature by the return sensor (RS) is the same as the set temperature (ST), for example, −25° C.

The humidifying means (3) for humidifying chamber (5) in the chilled mode is constituted by two humidifiers (3a) located on the left and the right side of the cooling passage (8) and a feed water circuit (A) connected therewith. The feed water circuit (A) is constructed such that the discharge side of feed water pump (P) is connected to the humidifiers (3a) by feed water pipe (20) and through three-way electromagnetic valves (27). Further, the feed water circuit (A) is constructed so that drainage pipes (21) connected with the humidifiers (3a) are linked to the suction side of the feed water pipe (P) through water tanks (T).

By means of the three-way electromagnetic valves (27), the feed water pipe (20) and the drainage pipe (21) are in communication with each other through bypass passage (BP). The bypass passage (BP) and the three-way electromagnetic valve (27) form feed water control means (28). This feed water control means (28) is interlocked with float switches (not shown in drawings) accomodated in the humidifiers (3a). The feed water control means (28) diverts the feed water in the feed water pipe (20) to the drainage pipe (21) when the volume of water stored in the humidifier (3a) exceeds a fixed volume.

The humidifiers (3a) adopt an overflow system and the water to be supplied to the humidifiers (3a) for generating a mist circulates through the feed water pump (P), the feed water pipe (20), the humidifiers (3a) and the drainage pipe (21). The heat exchanger (17) for the feed water is connected with the feed water pipe (20) to be installed between the hot gas bypass pipe (HB) and the feed water pipe (20). In this position, the heat exchanger (17) heat-exchanges the feed water of the humidifier (3a) with the hot gas of the refrigerant to warm the feed water. In addition, the feed water pipe (20) is provided with a branch pipe (22) downstream from the heat exchanger (17).

At the lower part of the evaporator (2a), a drain pan (D) having a drain pipe (23) for collecting water and residue during the defrosting operation is furnished. The drain pipe (23) is extended to the outside of partition (6) and connected with strainer (S). The outer drainage of the drain pipe (23) is opened and closed freely by closing valve (24), which opens to discharge the water of the humidifying means (3) when in the frozen mode. Drain pipe (23) is connected with the suction side of the feed water pipe (P). The drain pan (D) is provided with the drain pan heater (PH) and is connected to branch pipe (22) by the drain pan heater (PH). Some of the feed water in the humidifiers (3a) is supplied to the drain pan (D) from the branch pipe (22) and the drain pan heater (PH) warms up the water and residue of the evaporator (2a) as well as the feed water from the branch pipe (22). The volume of the water heated at the the heat exchanger (17) for the feed water and the drain pan heater (PH) is regulated by the amount of the hot gas supplied to the hot gas bypass passage (HB) by means of the three-way modulating valve (16). Reference numeral 25 designates a drain pipe having a closing valve (26) connected to the drain pan (D).

Cooling and humidifying for chamber (5) is described as follows.

In the refrigeration unit (2), the refrigerant compressed in the compressor (9) is condensed in each condenser (10), (11), is evaporated in the evaporator (2a) through the expansion valve (13), and is returned to the compressor (9). The cooling air cooled in the evaporator (2a) is discharged to chamber (5) from the discharge passage (7) to maintain the temperature in the chamber (5) at the set constant temperature.

In the case of the chilled mode, the controller (19) PID-controls the three-way modulating valve (16) when the detected temperature of the supply sensor (SS) becomes within the predetermined temperature range of the set temperature (ST). In return, the three-way modulating valve (16) controls the amount of hot gas flowing through the hot gas bypass passage (HB) to adjust the supply air temperature to the set temperature (ST). In this chilled mode, when the supply air temperature rise to not less than the predetermined range of the set temperature (ST), for example, to not less than 2° C. from set temperature (ST), the three-way modulating valve (16) supplies hot gas to each condenser (10), (11) (pull-down operation) to cool the inside of the chamber (5) quickly. On the other hand, when the supply air temperature falls to not more than the predetermined range of the set temperature (ST), for example, to not more than 2° C. from the set temperature (ST), the three-way modulating valve rapidly heats the inside of the chamber (5) by directing the flow of all the hot gas into the hot gas bypass passage (HB).

In the case of the frozen mode, the controller (19) closes the hot gas bypass passage (HB) by means of the three-way modulating valve (16) and regulates the compressor (9) according to the detected temperature of the return sensor (RS). For example, the controller (19) shuts off the operation of the compressor (9) when the suction air temperature becomes the set temperature (ST), while the controller (19) activates the compressor (9) to control the temperature inside the chamber (5) when the suction air temperature rises to the predetermined temperature range of the set temperature (ST).

The humidifying operation is conducted during the chilled mode. In the humidifying operation, when the feed water pump (P) is driven, the water fed from the feed water pump (P) passes through the heat exchanger (17) and flows into the humidifiers (3a). Inside the humidifiers (3a), a fixed amount of water is atomized and scattered by ultrasonic waves from the vibrator and the generated mist is discharged from the ejection nozzle (3c) toward the discharge passage (7). The mist, being mixed with cooling air, flows into the chamber (5) to increase the humidity therein. The feed water of the feed water pipe (20) is heat-exchanged with the hot gas flowing through the hot gas bypass passage (HB) to be heated, thus preventing the pipes from freezing.

The following description concerns the relationship between the amount of hot gas in the hot gas bypass passage (HB) and the warming of the feed water. The amount of hot gas is controlled in accordance with the cooling load. In other words, the amount of hot gas decreases when the heat entering into the chamber increases due to a higher external temperature, whereas the amount of hot gas increases when the heat entering into the chamber decreases due to a lower external temperature.

Since some portion of the humidifying means (3) is disposed outside of the containers which are in contact with the out-door air, when the out-door temperature is high, for example +30° C., the heat generated by the feed water is relatively small. On the other hand, when the out-door temperature is low, for example −30° C, the heat generated by the feed water is relatively large. As a result, in the case of high out-door temperature, both the amount of hot gas and the heat generated by the feed water become small, while in the case of low out-side temperature, the amount of hot gas increases due to the control of the three-way modulating valve (16), the heat generated by the feed water becomes large, and the heat absorption by the heat exchanger (17) for the feed water increases, thereby stabilizing the temperature of the feed water.

Figure 3:
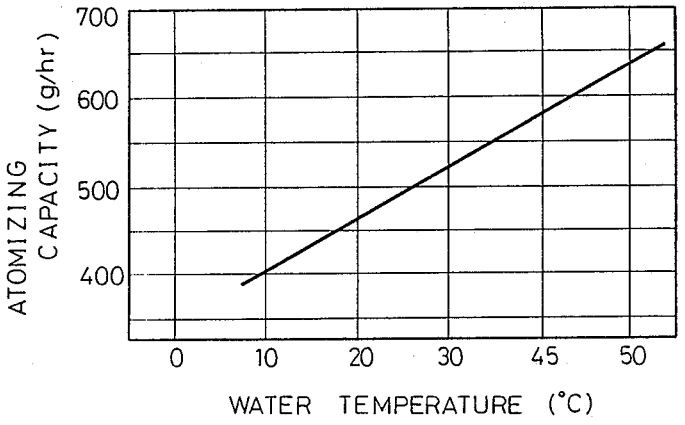
Figure 4:
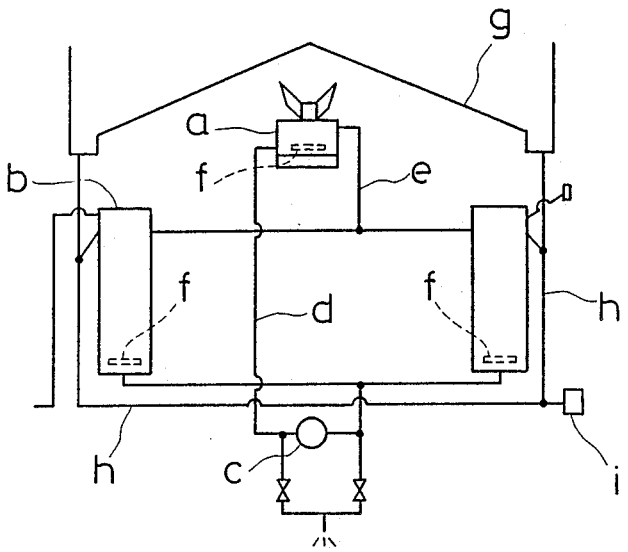
FIG. 4 Prior Art
FIG. 4 shows a feed water circuit of a conventional humidifying apparatus.

Water is continuously supplied to the humidifier (3*a*) from the feed pump (P). This water, which is used for spraying the mist, constantly circulates inside the feed water pipe (20), the humidifiers (3*a*), and the drainage pipe (21). In this way, the water does not remain in the feed pipe (20), thus preventing freezing of the pipes and the clogging of the pipes by dust therein. When a fixed amount of the water is stored in the humidifier (3*a*), the feed water pipe (20) and the drainage pipe (21) communicate with each other through the bypass passage (BP) by the operation of the three-way electromagnetic valve (27). This bypassed water is returned to the feed water pump (P) through the water tank (T). The feed water is bypassed because the atomizing capacity of the humidifier (3*a*) improves in accordance with the increase in the temperature of the stored water in humidifiers (3*a*) as shown in FIG. 3. The stored water in the humidifiers (3*a*) is heated by the heat generated by the vibrator and discharge of the warmed water is prevented to improve the atomizing capacity of the humidifiers. When draining off the water inside the humidifier (3*a*) in the case of maintenance thereof, the humidifying operation of the humidifying means (3) is shut off and the water is discharged into the drain pan (D) by opening the closing valve (26). When resuming the operation of the humidifier (3*a*), the water is re-supplied to the humidifier (3*a*) by means of the feed water pump (P).

Some of the feed water flowing through the feed water pipe (20) is directed to the branch pipe (22) and is constantly circulated into the drain pipe (23) through the drain pan (D). The feed water flowing to the drain pan (D) is warmed by the drain pan heater (PH). As mentioned earlier, the temperature of the feed water rises in accordance with the increase in the amount of hot gas flowing through the drain pan heater (PH) when the out-door temperature decreases. The warmed feed water returns to the feed water pump (P), further stabilizing the temperature of the feed water. When defrosting refrigeration unit (2), the water and residue discharged to the drain pan (D) flows through the drain pipe (23) after being warmed by the drain pan heater (PH). At this time, the water and residue passes through the strainer (S) where the dust present is removed, and the purified water is returned to feed water pump (P) via feed pipe (20).

When operating in the frozen mode, the humidifying operation is conducted with no flow of hot gas due to the closing of hot gas bypass pipe (HB). All the water inside the humidifying means (3) is discharged. Accordingly, no freezing inside the pipe occurs.

As described earlier, since heat exchanger (17) is provided in the apparatus, the water supplied to the humidifier (3*a*) from the feed water pipe (20) is warmed by being heat-exchanged with the hot gas used for controlling the temperature of the cooling air. This results in the prevention of pipe freezing without utilizing conventional heaters, thereby achieving a simple and cost efficient solution.

The water and residue collected in the drain pan (D) is warmed by the drain pan heater (PH). Therefore, freezing of the water and residue in the drain pipe (23) can be prevented.

In general, the feed water is heated because some of the feed water of the humidifiers (3*a*) is directed toward the drain pan (D) where the water is warmed by the drain pan heater (PH), and then returned to the feed water pump (P). As a result, freezing of the water in pipes is further prevented.

Furthermore, as discussed earlier, the surplus feed water is bypassed to the drainage pipe (21) in relation to the float switch disposed in the humidifiers (3*a*) when the amount of water stored inside the humidifiers (3*a*) exceeds the predetermined amount. This has led to a stable atomizing capacity of the humidifiers (3*a*) because the decrease in the temperature of the water stored inside the humidifiers (3*a*) is restricted. Furthermore, this makes possible the continuous supply of water to the humidifiers (3*a*), thereby preventing freezing of the water inside the pipes.

Another feature of the present invention is that the humidifiers (3*a*) are driven intermittently. This means that, for example, as compared with devices which drive and control ultrasonic humidifiers in accordance with detected signals from humidity sensors, no consideration with respect to the reliability of the humidity sensors is necessary. Consequently, in the present apparatus, no maintenace of the humidity sensor is required, improving reliability of humidity control.

What is claimed is:

1. A refrigeration apparatus for transport containers comprising:

a chamber including a refrigeration closed circuit including a compressor, a condenser, an expansion mechanism and an evaporator for generating cooling air to cool said chamber;

a hot gas bypass pipe for supplying a hot gas discharged from said compressor of said refrigeration closed circuit to the inlet side of said evaporator while bypassing said condenser and said expansion mechanism;

a flow control valve for controlling the amount of hot gas flowing through said hot gas bypass pipe;

hot gas control means for controlling said flow control valve to increase and decrease the amount of hot gas flowing through said hot gas bypass pipe in accordance with cooling load in said chamber during the chilled mode;

a humidifier for humidifying the cooled air inside said chamber;

feed water supply means disposed outside said chamber for providing a source of feed water to said humidifier;

feed water pipe means including a suction port for connecting said feed water supply means to said humidifier;

a heat exchanger disposed between a portion of said hot gas bypass pipe and a portion of said feed water pipe means for exchanging heat between said feed water and said hot gas;

a drain pan located at the lower part of said evaporator for collecting water and residue from said evaporator;

a branch pipe wherein one end thereof is connected with said feed water pipe means which is located on said humidifier side of said heat exchanger, and the other end thereof is disposed in said drain pan, said branch pipe introducing a portion of said feed water flowing through said feed water pipe means to said drain pan heated by said heat exchanger; and a drain pipe wherein one and thereof is connected with said drain pan, and the other and thereof is connected with the suction port of said feed water supply means.

2. The refrigeration apparatus as claimed in claim wherein said hot gas control means supplies hot gas discharged from said compressor to said condenser when the temperature in said chamber rises to not less then a predetermined set temperature range, and increases and decreases the amount of hot gas flowing through said hot gas bypass pipe to adjust the air temperature in said chamber to the set temperature when the air temperature in said chamber is within the predetermined set temperature range.

3. The refrigeration apparatus as claimed in claim 1 further comprising a drain pan heater wherein a portion of the hot gas bypass pipe is provided in said drain pan to warm water and residue.

4. The refrigeration apparatus as claimed in claim 1 wherein said humidifier comprises an ultrasonic humidifier, said humidifier being provided with timer means for outputting a signal to activate said ultrasonic humidifier for a predetermined time at a fixed period.

5. The refrigeration apparatus as claimed in claim 1 further comprising:

a float switch for detecting the amount of water stored in said humidifier;

a drainage pipe connected to said humidifier; and feed water control means for diverting said feed water from said feed water pipe means to said drainage pipe and bypassing said humidifier when the amount of water stored in said humidifier as detected by said float switch exceeds a predetermined amount.

6. A refrigeration apparatus for transport containers comprising:

a chamber including a refrigeration closed circuit including a compressor, a condenser, an expansion mechanism and an evaporator for generating cooling air to cool said chamber;

a hot gas bypass pipe for supplying a hot gas discharged from said compressor of said refrigeration closed circuit to the inlet side of said evaporator while bypassing said condenser and said expansion mechanism;

a flow control valve for controlling the amount of hot gas flowing through said hot gas bypass pipe;

hot gas control means for controlling said flow control valve to increase and decrease the amount of hot gas flowing through said hot gas bypass pipe in accordance with cooling load in said chamber during the chilled mode;

a humidifier for humidifying the cooled air inside said chamber;

feed water supply means including a suction port and disposed outside said chamber for providing a source of feed water to said humidifier;

feed water pipe means for connecting said feed water supply means to said humidifier;

a heat exchanger disposed between a portion of said hot gas bypass pipe and a portion of said feed water pipe means for exchanging heat between said feed water and said hot gas;

a drain pan located at the lower part of said evaporator for collecting water and residue from said evaporator;

a drain pan heater wherein a portion of said hot gas bypass pipe is provided in said drain pan to warm water and residue;

a branch pipe wherein one end thereof is connected with said feed water pipe means, and the other end thereof is disposed in said drain pan, said branch pipe introducing a portion of said feed water to said drain pan so that a portion of said feed water flowing through said feed water pipe means is warmed by said drain pan heater; and a drain pipe wherein one end thereof is connected with said drain pan, and the other end thereof is connected with the suction port of said feed water means.

7. A refrigeration apparatus for transport containers comprising:

a chamber including a refrigeration closed circuit including a compressor, a condenser, an expansion mechanism and an evaporator for generating cooling air to cool said chamber;

a hot gas bypass pipe for supplying a hot gas discharged from said compressor of said refrigeration closed circuit to the inlet side of said evaporator while bypassing said condenser and said expansion mechanism;

a flow control valve for controlling the amount of hot gas flowing through said hot gas bypass pipe;

hot gas control means for controlling said flow control valve to increase and decrease the amount of hot gas flowing through said hot gas bypass pipe in accordance with cooling load in said chamber during the chilled mode;

a humidifier for humidifying the cooled air inside said chamber;

feed water supply means including a suction port and disposed outside said chamber for providing a source of feed water to said humidifier;

feed water pipe means for connecting said feed water supply means to said humidifier;

a heat exchanger disposed between a portion of said hot gas bypass pipe and a portion of said feed water pipe means for exchanging heat between said feed water and said hot gas;

a float switch located in said humidifier for detecting the amount of water stored in said humidifier;

a drainage pipe connected to said humidifier; end feed water control means for diverting said feed water from said feed water pipe means to said drainage pipe and bypassing said humidifier when the amount of water stored in said humidifier as detected by said float switch exceeds a predetermined amount.

8. The refrigeration apparatus as claimed in claim 7 further comprising:

a drain pan located at the lower part of said evaporator for collecting water and residue from said evaporator;

a drain pan heater wherein a portion of the hot gas bypass pipe is provided in said drain pan to warm water and residue; end a drain pipe wherein one and thereof is connected with said drain pen, and the other and thereof is connected with the suction port of said feed water supply means.

9. The refrigeration apparatus as claimed in claim 8, further comprising a branch pipe wherein one end thereof is connected with said feed water pipe means, and the other end thereof is disposed in said drain pan, said branch pipe introducing a portion of said feed water to said drain pan so that a portion of said feed water to said drain pan so that a portion of said feed water flowing through said feed water pipe means is warmed by said drain pan

* * * * *

UNITED STATES PATENT AND TRADEMARK OFFICE

CERTIFICATE OF CORRECTION

PATENT NO. : 4,969,335

DATED : November 13, 1990

INVENTOR(S) : Sasaki et al.

It is certified that error appears in the above-identified patent and that said Letters Patent is hereby corrected as shown below:

On the title page item [73], add the following:

Daikin Industries, Ltd., Osaka, Japan

Column 10, lines 64-65, please delete "to said drain pan so that a portion of said feed water"; line 67, "heater" is missing from the end of the sentence.

Signed and Sealed this

First Day of December, 1992

*Attest:*

DOUGLAS B. COMER

*Attesting Officer*

*Acting Commissioner of Patents and Trademarks*